US006455167B1

(12) United States Patent
Rigney et al.

(10) Patent No.: US 6,455,167 B1
(45) Date of Patent: Sep. 24, 2002

(54) COATING SYSTEM UTILIZING AN OXIDE DIFFUSION BARRIER FOR IMPROVED PERFORMANCE AND REPAIR CAPABILITY

(75) Inventors: Joseph D. Rigney, Milford, OH (US); Irene T. Spitsberg, Loveland, OH (US); Ramgopal Darolia, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/345,002

(22) Filed: Jul. 2, 1999

(51) Int. Cl.[7] ..... B32B 15/00

(52) U.S. Cl. ..... 428/472.2; 428/469; 428/472; 428/702; 416/241 R

(58) Field of Search ..... 428/469, 472, 428/472.2, 702; 416/241 R, 241 B

(56) References Cited

U.S. PATENT DOCUMENTS 3,754,902 A * 8/1973 Boone et al ..... 75/171
5,015,502 A * 5/1991 Strangman et al
5,238,752 A * 8/1993 Duderstadt et al. ..... 428/632
5,302,465 A * 4/1994 Miller et al. ..... 428/552
5,427,866 A * 6/1995 Nagaraj et al. ..... 428/610
5,538,796 A * 7/1996 Schaeffer et al. ..... 428/469
5,658,614 A * 8/1997 Basta et al. ..... 427/253
5,683,825 A * 11/1997 Bruce et al. ..... 428/698
5,716,720 A * 2/1998 Murphy ..... 428/623
5,756,223 A * 5/1998 Cameron et al. ..... 428/688
5,985,467 A * 11/1999 Beele ..... 428/623

* cited by examiner

*Primary Examiner*—Deborah Jones
*Assistant Examiner*—Jennifer McNeil
(74) *Attorney, Agent, or Firm*—David L. Narciso; McNees Wallace & Nurick LLC; Carmen Santa Maria

(57) ABSTRACT

A coating is described for use on a superalloy substrate comprising a diffusion barrier as an intermediate layer overlying the substrate and underlying a protective coating having a high aluminum content. The diffusion barrier layer is characterized by having low interdiffusivity for elements from the substrate and the coating, a minimal impact on the mechanical properties of the article which is coated, and can be achieved readily using existing coating application techniques or post heat treat processes. The diffusion barrier layer is preferably an oxide ceramic.

16 Claims, 2 Drawing Sheets

COATING SYSTEM UTILIZING AN OXIDE DIFFUSION BARRIER FOR IMPROVED PERFORMANCE AND REPAIR CAPABILITY

BACKGROUND OF THE INVENTION

1. Field of the Invention

This invention relates to gas turbine engines, and more particularly, to a diffusion barrier layer applied to airfoils in the turbine portion of a gas turbine engine.

2. Discussion of the Prior Art

Coatings, such a diffusion aluminides and MCrAlX overlays, are used on airfoils exposed to hot combustion gases in gas turbine engines to protect them from oxidation and corrosion attack, and to function as bond coats in thermal barrier coating (TBC) systems. These coatings are applied over substrate materials, typically nickel-based superalloys, on the surfaces directly exposed to the environment by techniques such as thermal spray, electron beam physical vapor deposition (EB-PVD), magnetron sputtering, cathodic arc, and other physical deposition techniques. In the case when TBC systems are being created, an additional coating of a thermally resistant ceramic coating, such as yttria-stabilized zirconia (YSZ) is applied over the bond coat. TBC coatings are typically applied by EB-PVD or thermal spray techniques.

The MCrAlX designation for the overlay coating generically describes a variety of chemical compositions that may be employed as environmental coatings or bond coats in TBC systems. In this and other forms, M refers to an element consisting of Ni, Co and Fe, or combinations thereof. X denotes elements selected from the group consisting of Ta, Re, Ru, Pt, Si, B, C, Hf, Y, Pt and Zr and combinations thereof. Recent developments in such overlay coatings have identified NiAlCrZr and NiAlZr bond coats as providing significant benefits in TBC spallation resistance over certain baseline TBC systems. Preferred composition ranges for NiAlCrZr and NiAlZr are described in pending application Ser. Nos. 09/166,883 (filed Oct. 6, 1998); 08/932,304 (filed Sep. 17, 1997, and CIP 09/232,518 (filed Jan. 19, 1999), respectively, assigned to the assignee of the present invention and incorporated herein by reference.

Service exposure of components with these environmental coatings (including TBC systems) under the hot, oxidative, corrosive environment causes a number of metallurgical processes to alter the airfoil system. Initially, the aluminum-rich coating forms a highly adherent thermally grown oxide (TGO) layer which grows at the interface between the diffusion aluminides or MCrAlX overlay bond coats and ceramic coatings. With further high temperature service exposure, spallation of the YSZ topcoat occurs at either the bond coat/alumina interface or at the alumina/YSZ interface. Although many factors influence the spallation performance of the TBC systems, it is clear that the interdiffusion of elements, which modifies the local chemistries of the substrate, bond coating and TGO, plays a major role in degrading the system. Essentially, there is a tendency for aluminum (Al) from the aluminum-rich overlay coating to diffuse into the substrate, while traditional alloying elements, such as Co, Cr, W, Re, Ta, Mo, and Ti present in the superalloy, migrate from the substrate into the coating as a result of compositional gradients. The depth of interdiffusion and extent of elemental change will depend on chemistry and temperature. The diffusional loss of Al to the substrate reduces the concentration of Al in the overlay coating, thereby reducing the ability of the overlay coating to continue generation of highly protective and adherent alumina scale. Simultaneously, the migration of the aforementioned superalloy elements likely affects the protective properties of the alumina. Another result of interdiffusion of Al and coating elements is the formation of a diffusion zone into the airfoil wall which results in the undesirable consumption of the load bearing airfoil wall.

What is needed is a diffusion barrier between the overlay coating and the substrate alloy that prolongs coating life by extending the time the coating chemistry provides a protective and adherent alumina scale, while being essentially chemically stable, being in contact with the bond coat and the superalloy, and highly adherent to both the substrate superalloy and the bond coat. In addition, the diffusion barrier should have low solubility and interdiffusivity with elements from the substrate and coating, and be easily deposited. The diffusion barrier should be as thin as possible to minimize the amount of weight added to the system. Intermetallics and solid solution alloys having compositions that are thermodynamically stable and that do not readily combine with aluminum to form new phases are likely candidates for diffusion barriers. These metallic materials are described in pending application Ser. No. 09/275,096 filed Mar. 24, 1999, assigned to the assignee of the present invention. The thicknesses of these metallic alloys may be somewhat greater than is otherwise attainable utilizing ceramic layers and may permit some diffusion of aluminum, either through the matrix or, in some circumstances, along the grain boundaries. Nevertheless, these metallic materials represent one potential solution to the problem of extending the life of airfoil coating systems. However, a very thin coating of a non-metallic material that is substantially impermeable to aluminum is another solution.

BRIEF SUMMARY OF THE INVENTION

The present invention is directed toward a thin diffusion barrier layer for use as an intermediate layer between a nickel-base superalloy substrate, and in its broadest embodiment, an outer aluminum-containing layer. The diffusion barrier layer is a ceramic, such as an oxide, that forms a tightly adherent, thin film which is compatible with a nickel-base superalloy. The "barrier" characteristics of this film is based on the reduced ability of aluminum from the bond coat and elements from the substrate to diffuse through it at elevated temperatures. Another aspect of the invention is that the ceramic diffusion barrier layer is applied to the substrate in such a manner so as to be both chemically bonded and optionally mechanically bonded to the substrate.

The airfoil of the present invention provides a system that increases the life expectancy of the airfoil by increasing the spallation resistance of applied coatings and minimizing the effects of interdiffusion, the system comprising of a substrate material, a thin ceramic layer chemically and optionally mechanically bonded to the substrate layer. A protective overlay coating that includes aluminum is applied over the thin oxide layer, the overlay coating being at least chemically bonded to the thin oxide layer and optionally mechanically bonded to the thin oxide layer, the overlay coating including an outer protective scale of alumina, and, when the overlay coating is used as a bond coat, an optional thermal barrier coating overlying the alumina. When no thermal barrier coating is applied, the overlay coating having the protective alumina scale forms a protective environmental layer.

An advantage of the present invention is that it slows down the growth of a diffusion layer from an outer aluminum-containing layer into a nickel-base substrate material. Thus, the airfoil maintains a substantial portion of its wall thickness so that, during repair, material removal is reduced as the diffusion zone is thinner. This in turn means that the airfoil can undergo multiple repair cycles.

Another advantage of the system of the present invention is that the diffusion barrier layer reduces the loss of aluminum, a critical scale-forming element, by inhibiting the inward migration of aluminum from the outer protective coating to the lower-aluminum containing substrate. As a result, the oxidation and corrosion resistance of the coating is maintained when the coating is used as an environmental coating. The adherence of the ceramic top coat is maintained when the coating is used as a bond coat leading to longer mean life between repairs. Additionally, the diffusion barrier also advantageously retards or prevents the outward migration of one or more substrate elements into the coating during high temperature operation. It is believed that the outward migration of some of these elements adversely affects the protective properties of the alumina scale.

The present invention provides for an article for use in a high temperature oxidative environment comprising a nickel-based superalloy substrate. Overlying the nickel-based superalloy substrate is a tightly adherent layer that acts as a diffusion barrier. The diffusion barrier layer is an intermediate coating between the substrate and an outer coating having a high concentration of aluminum. Typically, the overlay coating is designated as MCrAlX. The ceramic diffusion barrier layer ideally is a tightly adherent ceramic such as an oxide having thermodynamic stability at or above the temperatures of operation, a low diffusion permeability, low solubility for Al from the coating and ideally low solubility for refractory elements such as W, Ta, Mo, Re and other elements such as Ti and Co typically found in the substrate. Finally, the diffusion barrier layer is sufficiently bonded to both the outer protective coating and the superalloy to survive the high temperature atmosphere and thermal fluctuations experienced in a gas turbine engine.

An advantage of such diffusion barriers is that they are typically limited to less than a few microns in thickness so that it can be applied without adversely affecting the weight of the airfoil. Weight added to blades rotating at high speeds has a detrimental effect on stresses, which in turn has a detrimental effect on fatigue life.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE PREFERRED EMBODIMENTS

Figure 1:
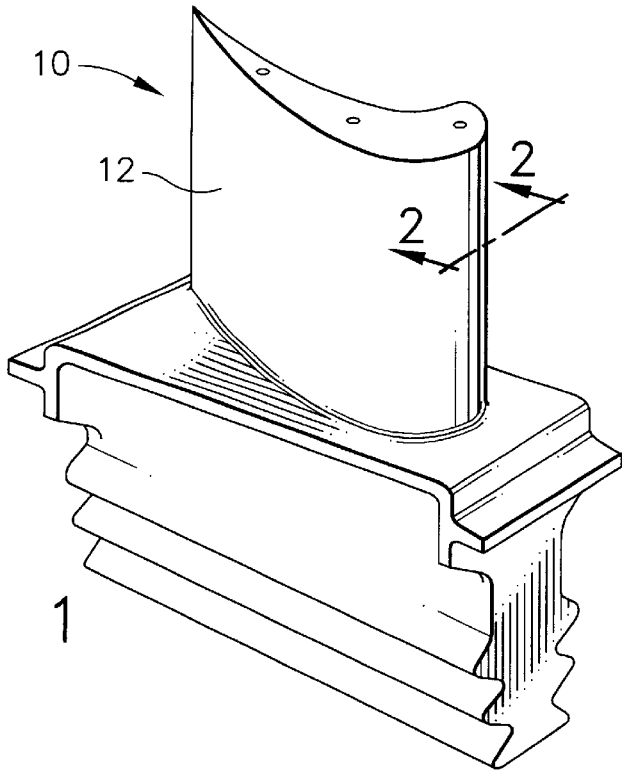
FIG. 1 is a perspective of a turbine airfoil.
Figure 2:
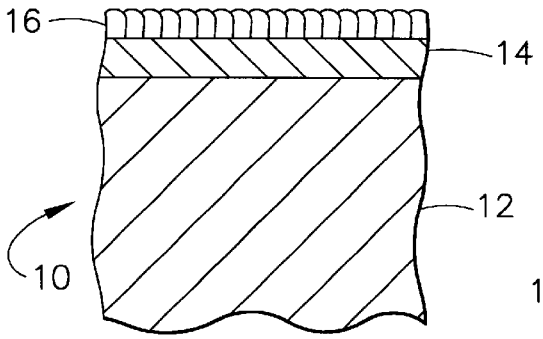
FIG. 2 (PRIOR ART)
FIG. 2 is a cross-sectional view of a prior art airfoil having an outermost thermal barrier layer after manufacture and prior to being placed into service.

The present invention provides an improved airfoil for use in a high temperature oxidative and corrosive environment such as is found in the turbine portion of a gas turbine engine. Typically, these airfoils are blades and vanes, and comprise a nickel-based superalloy substrate and a coating or coatings to impart improved environmental protection or improved high temperature capabilities to the airfoil. When environmental protection is required, a coating such as a MCrAlX, where M is an element selected from the group consisting of Ni, Fe and Co and combinations thereof and X is an element selected from the group consisting of Ta, Re, Ru, Pt, Si, B, C, Hf, Y, Pt and Zr and combinations thereof, is applied directly over the substrate. When high temperature capabilities are required, a thermal barrier layer typically an oxide, such as YSZ, is applied over the MCrAlX which serves as a bond coat between the thermal barrier layer and the substrate. FIG. 1 is a perspective of a typical airfoil such as a turbine blade. A cross section of a prior art turbine blade 10 prior to being placed in service, having such a thermal barrier layer is shown in FIG. 2, in which the nickel based superalloy substrate 12 is overlaid with an aluminum-based bond coat. Overlying the bond coat is a topcoat of yttria stabilized zirconia having a composition such as 93 wt % zirconia stabilized with about 7 wt % yttria (7YSZ). A typical single crystal nickel-based superalloy substrate is Rene N5, having a nominal composition by weight of 7.5% Co, 7.5% Cr, 6.2% Al, 6.5% Ta, 5% W, 3% Re, 1.5% Mo, 0.15% Hf, 0.05% C, 40 ppm B, 20–300 ppm Y and the balance Ni and incidental impurities.

Figure 3:
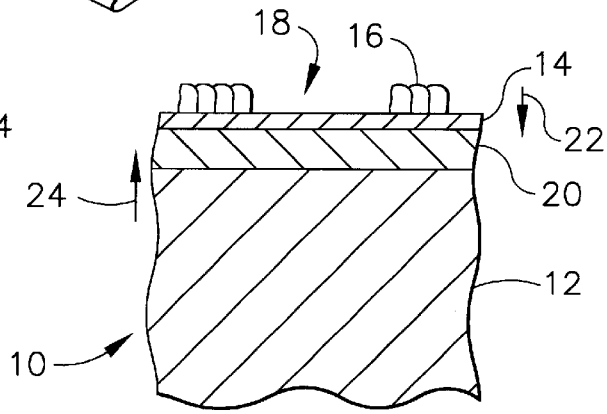
FIG. 3 (PRIOR ART)
FIG. 3 is a cross-sectional view of a prior art airfoil after being placed into service and just prior to its removal from service, the directional arrows showing the inward and outward diffusion of elements during service.

FIG. 3 is a cross-sectional view of the prior art airfoil of FIG. 1 after service in a gas turbine engine just prior to its removal. The ceramic topcoat 16 of YSZ exhibits some spallation 18, indicated by the voids, as YSZ has peeled away from bond coat 14. The peeling is aided by the fact that the bond coat 14 no longer has the same composition as when it was first deposited. Below bond coat 14 is a diffusion layer 20 that is formed as aluminum from the bond coat 14 diffuses in toward the lower aluminum content superalloy substrate as indicated by arrow 22, leaving the bond coat depleted of aluminum, which of course is a necessary element for the tightly adherent alumina scale. Simultaneously, although at different rates, substrate elements such as Co, W, Re, Ta, and Mo diffuse outwardly as indicated by arrow 24 from the substrate through the diffusion zone into the overlay coating, further affecting the properties of the thin alumina scale formed at the bond coat/ceramic interface and contributing to the deterioration of the bond capabilities of the coating, causing the spallation of the ceramic top coat.

Figure 4:
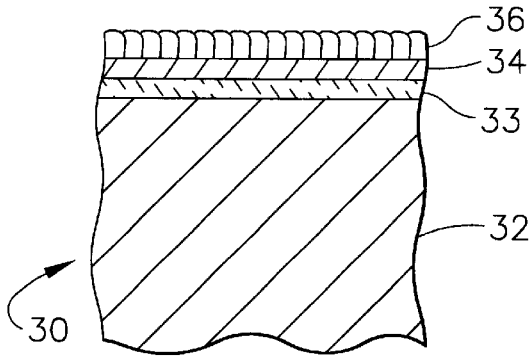
FIG. 4 is a cross-sectional view of an airfoil of the present invention having an outermost thermal barrier layer after manufacture and prior to being place into service.
Figure 5:
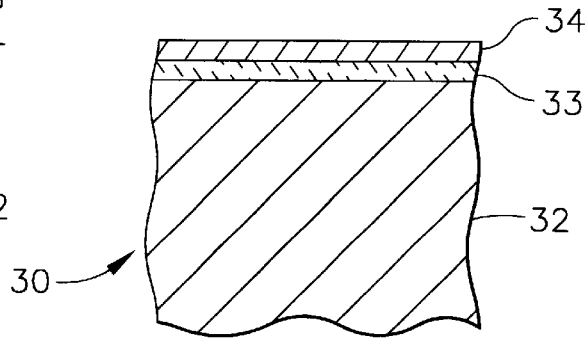
FIG. 5 is a cross-sectional view of an airfoil of the present invention in which the outermost layer forms a protective environmental layer, after manufacture and prior to being place into service.

The present invention as set forth in FIG. 4 provides for an airfoil 30 for use in a turbine section of a gas turbine engine. The airfoil having a superalloy substrate 32. Although the substrate airfoil may be any superalloy, including cobalt-based superalloys, Ni-based superalloys and Fe-based superalloys, preferred compositions include Rene N5, Rene 80, Rene 142 and Rene N6, four well-known airfoil superalloys, as well as the next generation of single crystal alloys such as MX4 alloys whose compositions are described in U.S. Pat. No. 5,482,789, issued Jan. 9, 1996, and assigned to the assignee of the present invention. Overlying the superalloy substrate 32 is a tightly adherent, thin ceramic diffusion barrier layer 33 having a thickness of from less than 1 micron to about 10 microns. Overlying the diffusion barrier layer 33 is a coating 34 having a high concentration of aluminum, such as MCrAlX coatings. These coatings 34 may be used as environmental coatings or as bond coats, and the outer portion of the coating forming a tightly adherent, thermally grown, alumina scale. When used as a bond coat, a ceramic topcoat 36, typically 7YSZ, is applied as a thermal barrier coating to allow performance at even higher temperatures, as shown in FIG. 4. When used as an environmental coat, as shown in FIG. 5, the MCrAlX coatings form the outermost surface of the airfoil, a thin layer of alumina scale (not shown) forming on the surface of the outer most coating.

The ceramic diffusion barrier layer 33 of the present invention is formed between the superalloy substrate and the overlying aluminum-containing bond coat, typically an overlay aluminide. The ceramic diffusion barrier layer is substantially impermeable to diffusion of atoms from either the substrate or from the overlying aluminum-containing bond coat. It is thermally stable and has a low aluminum self-diffusion coefficient. Furthermore, to increase the mean life between repairs of an airfoil, it should have greater adherence to the bond coat 34 and to the substrate 32 than any applied thermal barrier coating 36 has to the thermally grown oxide (not shown), alumina, formed on the outer surface of the bond coat. The ceramic diffusion barrier layer 33 essentially creates a stable zone between the underlying substrate 32 and the overlying bond coat 34 that prevents interactions, which are usually undesirable, between the substrate 32 and the bond coat 34. It has been found that certain oxides form desirable diffusion barrier layers, and, among these, alumina-based oxides, form a preferred diffusion barrier layer.

The ceramic diffusion barrier layer 33 of the present invention ideally should function to both prevent the diffusion of Al in bond coat 34 inward toward substrate 32 and prevent the diffusion of refractory elements from the substrate 32 outward into bond coat 34. In addition, this ceramic diffusion barrier layer 33 must be chemically compatible with both bond coat 34 and the superalloy substrate 32 at high temperatures of operation. The ceramic diffusion barrier layer 33 should be sufficiently bonded to both bond coat 34 and to superalloy substrate 32 so as not to cause spallation during thermal cycling and should have greater adherence to both bond coat 34 and substrate 32 than the adherence of a thermal barrier top coat 36 applied over the outer surface of bond coat 34. It must also have sufficient strength at interfaces with the bond coat and with the substrate so that stresses resulting from thermal cycling will not cause fatigue failures.

Oxide diffusion barrier layers can be thin and can provide the desired characteristics. A preferred oxide layer that is chemically inert is alumina. This alumina layer, even when thin, significantly reduces the migration of aluminum from bond coat 34 inwardly and significantly reduces the migration of refractory elements outwardly from substrate 32 into bond coat 34, thereby assisting in stabilizing the compositions of both bond coat 34 and substrate 32. Alumina forms a strong chemical bond with all nickel-base superalloy substrates used in airfoils. It also forms a strong chemical bond with bond coat 34 when bond coat 34 is MCrAlX. MCrAlX bond coats include compositions in which M is an element selected from the group consisting of Fe, Co and Ni and combinations thereof, while X is an element consisting of Ti, Ta, Re, Si, B, C, Y, Hf, Zr and Pt, and combinations thereof.

Figure 6:
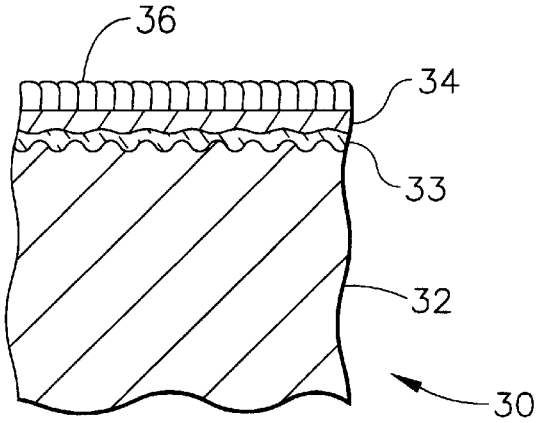
FIG. 6 is a cross-sectional view of an airfoil of the present invention in which mechanical bonding is provided by roughening the substrate surface, creating an irregular interface between the applied oxide diffusion barrier layer and the substrate.

If additional strength is required between either the ceramic oxide diffusion barrier layer and the substrate, or between the ceramic oxide diffusion barrier layer and the bond coat, a mechanical bond can be created between the layers. A typical method such as shown in FIG. 6 for forming a mechanical bond between substrate 32 and ceramic oxide diffusion barrier layer 33 is to roughen the surface of the substrate 32 before the forming the oxide diffusion barrier layer on the substrate surface. However, a stronger mechanical bond can be formed at the interface between substrate 32 and oxide diffusion barrier layer 33 and at the interface between the oxide diffusion barrier later and bond coat 34 by forming fine oxides that extend across one or both interfaces. These oxides serve as pegs or anchors across the interfaces, thereby adding additional mechanical strength to the already strong chemical bonding.

In one embodiment, a thin, tightly adherent alumina ceramic oxide layer is formed on the surface of a Ni-base superalloy substrate by simply subjecting the substrate to an oxidizing heat treatment at a temperature above about 1800° F. Aluminum, inherent in all commonly used nickel-base superalloy substrates used in airfoil applications, such as, for example, Rene N5 having a nominal composition of 6.2 w/o Al, oxidizes at the surface of the substrate forming a tightly adherent alumina film. While the film thickness will depend on the temperature and the length of time at temperature, and the film thickness may vary from less than one micron to about ten microns, in order to minimize the growth of alumina at the surface of the substrate, a satisfactory thickness of the alumina diffusion barrier has been found to be about 1 micron.

If additional strength is required between the ceramic oxide diffusion barrier layer, such as layer 33, and substrate 32, then mechanical bonding can be generated between the ceramic oxide diffusion barrier layer 33 and the substrate 32 by fine oxides of reactive elements, including at least one element selected from the group consisting of Zr, Y, Ca, Cs and Hf. These reactive elements may already be present in the substrate in sufficient amounts to cause the formation of internal oxides during a subsequent heat treatment after application, for example, of the preferred MCrAlX coating. The subsequent heat treatment causes the formation and growth of the internal oxides across the interface between the substrate 32 and the alumina diffusion barrier layer 33.

Figure 7:
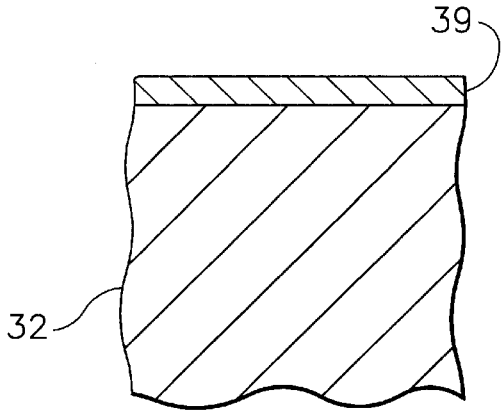
FIG. 7 is a cross section of a substrate having a pre-bond coat applied before applying an oxide diffusion barrier and bond coat layer.
Figure 8:
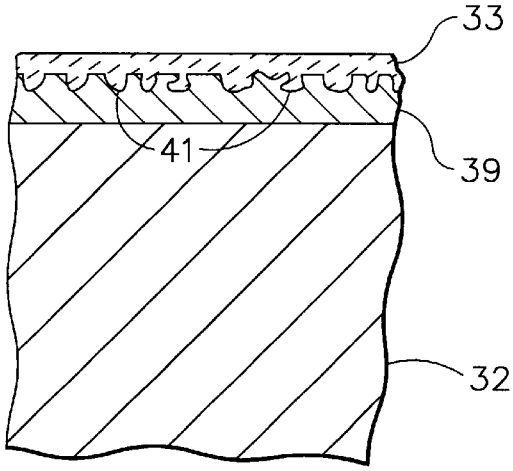
FIG. 8 is a cross section of the substrate of FIG. 7 after a heat treatment that forms mechanical interlocks and a diffusion barrier but before application of a bond coat.
Figure 9:
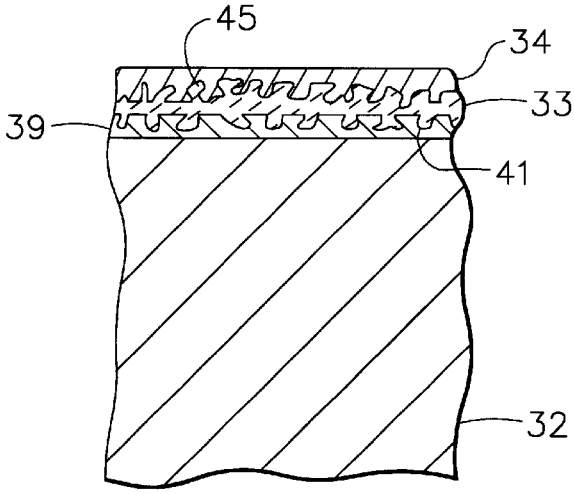
FIG. 9 is a cross section of a substrate having an applied bond coat and a pre-bond coat that is heat treated to form chemical and/or mechanical interlocks between the diffusion barrier layer and both the applied bond coat and the pre-bond coat.

If the substrate does not include sufficient reactive elements, or if fine oxides are desired to additionally anchor the alumina diffusion barrier layer mechanically, then a pre-bond coat can be applied to the surface of the substrate. The pre-bond coat 39 as shown in FIGS. 7 and 9 can be a thin aluminide coating, preferably from about one to 25 microns in thickness, that includes reactive elements, including at least one element selected from the group consisting of Zr, Y, Hf, Cs and Ca and applied over the substrate. After an initial heat treatment to form the alumina diffusion barrier layer 33 which may have pegs 41 to mechanically enhance the chemical bonding, a bond coat 34, in the preferred embodiment a MCrAlX overlay bond coat, is applied over the diffusion barrier layer 33. A subsequent heat treatment in the temperature range of 2000–2100° F. for a time sufficient to cause the growth of the internal oxides or enhanced chemical bonding across the interface between alumina diffusion barrier layer 33 and the bond coat 34, thereby providing additional strength in the form of mechanical bonds or chemical bonds across this interface as shown in FIG. 9. The time can be from about an hour or less, or as long as 50 hours. It will be recognized by those skilled in the art, that once the coated substrate is placed into service, it will be heat treated "in-situ". The heat treatment will also generate a thermally grown oxide (not shown) at the outer surface of the aluminide bond coat. A thermal barrier layer, such as YSZ then can be applied over the aluminide bond coat to complete the thermal barrier coating system.

In another embodiment, the oxide diffusion barrier coating in the form of an alumina scale is applied directly to the substrate or to a pre-bond coat applied to the substrate. As set forth above, if no mechanical interlocks are required, or if the substrate includes sufficient reactive metals to form the requisite amounts of fine oxides across the substrate/diffusion barrier interface during a subsequent heat treatment, then no pre-bond coat is required. If the substrate does not include sufficient amounts of reactive elements or if mechanical interlocks are required across both interfaces of the diffusion barrier, then a pre-bond layer including the previously noted reactive elements may be deposited over the substrate. However, in this embodiment, a thin layer of alumina having a thickness of about 10 microns and preferably of about 1 micron or less is directly deposited over either the substrate surface or the pre-bond coat applied to the substrate surface. Unlike the prior embodiment in which the alumina was thermally grown over the underlying material, in this embodiment, a thin layer of oxide, alumina for example, is directly applied to the underlying material by sputtering, organo-metallic chemical vapor deposition or by electron beam physical vapor deposition. The applied oxide layer may also include reactive elements that can assist in the formation of oxides as pegs during subsequent heat treatment. The bond coat can then be applied over the diffusion barrier and fine oxides forming the mechanical interlocks, when required, can be grown in a thermal treatment as set forth above. Then, the YSZ thermal barrier coating may be applied over the bond coat in the conventional manner.

In yet another embodiment, a MCrAlX overlay bond coat is applied over the ceramic oxide diffusion barrier layer, which may be formed by any of the above methods. However, in order to strengthen the interface between the alumina diffusion barrier layer and the overlay bond coat, the overlay bond coat is graded; that is to say, it has a varied composition that includes reactive elements that can form oxides. The overlay bond coat is deposited over the diffusion barrier layer so that the first portions of deposited bond coat, the portions adjacent to the diffusion barrier layer, include higher concentrations of reactive element additions, which concentrations decrease with increasing distance from the diffusion barrier layer. The bond coat at the interface with the underlying layer could have the same composition as the underlying layer or could have a different composition. Subsequent heat treatment of the system to develop the pegs will result in additional mechanical interlocks 45 being generated within the bond coat and across the interface between the bond coat and the underlying layer, ultimately strengthening the diffusion barrier due to the formation of additional precipitates of reactive oxides in the bond coat at the interface with the underlying layer. These precipitates grow across the interface from the bond coat into the underlying layer as well as from the underlying layer into the bond coat. As previously noted, a typical heat treatment can be accomplished in the range of about 1800–2200° F., and preferably in the range of 2000–2100° F., for an hour or less up to as long as 50 hours.

EXAMPLE 1

Twenty test coupons were prepared in accordance with the prior art teachings to form a baseline to assess the present invention. A diffusion aluminide bond coat of (Ni,Pt)Al was applied over a Rene N5 superalloy substrate. A thermal barrier coating of 7YSZ was applied over an outer surface of protective alumina formed during the thermal barrier coating process. The test coupons were subjected to standard thermal fatigue life tests at 2125° F. for one hour cycles in an atmosphere simulating that experienced in the turbine portion of a gas turbine engine. These (Ni, Pt)Al baseline test coupons survived an average of 230 cycles.

EXAMPLE 2

Three test coupons were prepared in accordance with the teachings to the present invention. For each specimen, a diffusion barrier layer of alumina was thermally grown to a thickness of less than one micron over Rene N5 superalloy substrate by heat treating the substrate in air to a temperature of about 1120° C. (2048° F.) for a length of time of about three hours. An overlay bond coat of NiAlZr was applied by magnetron sputtering over the alumina diffusion barrier. The coated substrate was then treated in a vacuum at a temperature of about 1150° C. (2100° F.) for a length of time of about 48 hours to generate a chemical bond between the alumina diffusion barrier and the aluminide bond coat. A thermal barrier coating of YSZ was applied over the outer surface of the bond coat. The coupons were subjected to the standard thermal fatigue spallation life test at 2125° F. for one hour cycles. The test coupons survived 360 cycles, 380 and 440 cycles, for an average life of about 400 cycles. Two specimens were similarly prepared with NiAlZr bond coats but without a thermally grown oxide diffusion barrier. These control specimens failed at values of 200 and 460 cycles for an average of 330 cycles. The specimens with the diffusion barrier demonstrated a modest increase over the control specimens and about 75% increases over the (Ni,Pt)Al bond coat baseline.

EXAMPLE 3

Three test coupons were prepared in accordance with the teachings to the present invention. For each specimen, a Rene N5 superalloy substrate was treated with a pre-layer of an overlay of NiAlHf applied by magnetron sputtering. This pre-layer was applied to a thickness of about 10–12 microns. An alumina scale forming the diffusion barrier layer was grown over the pre-layer to a thickness less than 1 micron by heat treating the coated substrate to a temperature of 1120° C. (2048° F.) in air for a length of time of about 3 hours. An overlay bond coat of NiAlZr was applied by magnetron sputtering over the diffusion barrier layer. The coated substrate was then treated in a vacuum at a temperature of 1150° C. (2100° F.) for a length of time of about 48 hours to form oxides and to form mechanical interlocks between both the pre-bond coat and the alumina diffusion barrier layer and between the diffusion barrier layer and the aluminide bond coat. A thermal barrier coating of YSZ was applied over the outer surface of the bond coat. The test coupons were subjected to the standard thermal fatigue spallation life test at 2125° F. for one hour cycles. One coupon survived 1420 cycles, while the two remaining coupons failed at 2180 and 2320 cycles. The average life was about 1970 cycles, at least a six-fold increase over the control specimens without a diffusion barrier described in Example 2 and about a nine-fold increase over the (Ni,Pt)Al bond coat baseline of Example 1.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. An improved turbine airfoil comprising:

a superalloy substrate;

a tightly adherent, thin ceramic diffusion barrier layer overlying the superalloy substrate;

a metallic layer including aluminum overlying the ceramic diffusion barrier layer; and a layer of alumina overlying the metallic layer.

2. The airfoil of claim 1 wherein the tightly adherent ceramic diffusion barrier layer is a thin oxide scale.

3. The airfoil of claim 2 wherein the tightly adherent oxide scale is alumina.

4. The airfoil of claim 3 wherein the scale has a thickness of about 10 microns or less.

5. The airfoil of claim 4 wherein the scale has a thickness of about 1 micron.

6. The airfoil of claim 1 wherein the superalloy substrate is a nickel-base superalloy.

7. The airfoil of claim 1 wherein the metallic layer including aluminum is an aluminide.

8. The airfoil of claim 7 wherein the aluminide further includes at least one element selected from the group consisting of platinum, nickel, palladium and combinations thereof.

9. The airfoil of claim 8 wherein the aluminide further includes an overlay coating comprising at least one element selected from the group consisting of Zr, Cr, Hf, Si, Y, Ti, Pt and combinations thereof.

10. The airfoil of claim 1 wherein the layer including aluminum is an overlay coating of MCrAlX in which M is an element selected from the group consisting of Fe, Ni, Co, and combinations thereof and X is an element selected from the group consisting of Ti, Si, Re, Pt, B, C, Y, Hf, Zr and combinations thereof.

11. The airfoil of claim 1 further including a ceramic overcoat overlying the metallic layer including aluminum and the layer of alumina.

12. The airfoil of claim 11 wherein the ceramic overcoat is yttrium-stabilized zirconia.

13. An improved turbine airfoil comprising:

a nickel-based superalloy substrate;

a thin, diffusion barrier ceramic oxide layer formed on the nickel-based superalloy substrate by an oxidizing heat treatment of the substrate so that the layer forms an adherent chemical bond with the substrate at an interface between the superalloy substrate and the layer;

a layer including aluminum applied over the ceramic oxide layer; and fine oxides extending across the superalloy/oxide interface by internal oxidation as a result of exposure to a high temperature to form a mechanical bond between the superalloy substrate and the ceramic oxide layer.

14. The turbine airfoil of claim 13 wherein the ceramic oxide layer is alumina having a thickness of about one micron.

15. The improved turbine airfoil of claim 13 further including fine oxides extending across the oxide/aluminum-including layer interface by exposure to a high temperature to form a mechanical bond between the superalloy substrate and the ceramic oxide layer.

16. An improved turbine airfoil comprising:

a nickel-based superalloy substrate having a roughened surface of at least about 50 microns or rougher;

a thin ceramic oxide layer formed on the nickel-based superalloy substrate by an oxidizing heat treatment of the substrate at a first elevated temperature so that the layer forms an adherent chemical bond with the substrate at an interface between the superalloy substrate and the layer;

a layer including aluminum applied over the oxide layer; and a tightly adherent oxide layer grown onto the nickel-based superalloy substrate from the superalloy/oxide interface by exposure to a first elevated temperature heat treatment, thereby forming a mechanical bond at the interface between the roughened superalloy substrate surface and the ceramic oxide layer by exposure to a second elevated temperature heat treatment.

* * * * *